US006655819B2

(12) United States Patent
Loga et al.

(10) Patent No.: US 6,655,819 B2
(45) Date of Patent: Dec. 2, 2003

(54) LUMINAIRE

(75) Inventors: Simona Loga, Bregenz (AT); Georg Kempter, Bregenz (AT)

(73) Assignee: Zumtobel Staff GmbH, Dornbirn (AT)

( * ) Notice: Subject to any disclaimer, the term of this patent is extended or adjusted under 35 U.S.C. 154(b) by 0 days.

(21) Appl. No.: 10/214,108

(22) Filed: Aug. 8, 2002

(65) Prior Publication Data

US 2003/0007348 A1 Jan. 9, 2003

Related U.S. Application Data

(63) Continuation of application No. PCT/EP01/01269, filed on Feb. 6, 2001.

(30) Foreign Application Priority Data

Feb. 14, 2000 (DE) ..... 100 06 410

(51) Int. Cl.[7] ..... F21V 5/00
(52) U.S. Cl. ..... 362/263; 362/222; 362/223
(58) Field of Search ..... 362/263, 217, 362/222, 223, 224, 225

(56) References Cited

U.S. PATENT DOCUMENTS

| | | | | |
|---|---|---|---|---|
| 4,277,820 A | | 7/1981 | Bostonian | 362/223 |
| 4,310,876 A | * | 1/1982 | Small, Jr. et al. | 362/298 |
| 4,835,661 A | * | 5/1989 | Fogelberg et al. | 362/97 |
| 5,530,628 A | * | 6/1996 | Ngal | 362/33 |
| 5,685,633 A | * | 11/1997 | Engel | 362/223 |
| 5,931,567 A | | 8/1999 | Salzmann et al. | 362/304 |
| 6,155,693 A | | 12/2000 | Spiegel et al. | 362/147 |

FOREIGN PATENT DOCUMENTS

| | | |
|---|---|---|
| DE | 4336023 A1 | 4/1995 |
| DE | 4443916C11 | 5/1996 |
| DE | 29710475 U1 | 9/1997 |
| DE | 19620659 A1 | 11/1997 |
| EP | 0574761 A1 | 12/1993 |
| NL | 17207 | 9/1927 |

* cited by examiner

*Primary Examiner*—Laura K. Tso
(74) *Attorney, Agent, or Firm*—Fitzpatrick, Cella, Harper & Scinto

(57) ABSTRACT

A luminaire having a tube-shaped gas discharge lamp (1) contains at least one concavely curved reflector (2) arranged—seen from the region to be illuminated—neighboring the lamp (1), and at least one partially light permeable diffusor (3) arranged—likewise seen from the region to be illuminated—neighboring the lamp (1) but before the reflector (2). The diffusor (3) and the reflector (2) bound next to the lamp (1) at least one light entry surface and run together at their ends away from the lamp (1) such that they enclose at least one light chamber (4), the ratio between the width (a) of a light chamber and the height (b) of a light entry surface being at least 4:1. Further, there may be provided means for the attainment for a uniform light density over the width of the reflector.

20 Claims, 5 Drawing Sheets

( State of the Art )

LUMINAIRE

CROSS REFERENCE TO RELATED APPLICATIONS

This is a continuation of International Application No. PCT/EP01/01269, filed on Feb. 6, 2001, which claims priority of German Application No. DE 100 06 410.8 filed Feb. 14, 2000, the priority of both of which are claimed under 35 U.S.C. §§119 and 120. The International application was published in German but not in English as WO 01/59364 A1 on Aug. 16, 2001.

BACKGROUND OF THE INVENTION

Field of the Invention

The invention relates to a luminaire having a curved reflector and a light permeable diffuser arranged neighboring a lamp and spaced apart in a manner to define a light chamber having a light entry surface which defines a height near the lamp, and running together at their ends away from the lamp to define a width extending from the light entry surface.

A luminaire of this kind, as is described for example in DE 44 43 916 A1, is illustrated in FIG. 14. There, arranged below an elongate gas discharge lamp 21, there is a raster reflector 26 consisting of side reflectors and transverse lamellae, with the aid of which raster reflector the greater part of the light emitted by the lamp 21 is directed and emitted downwardly without a dazzling effect. The employment of such a raster reflector 26 is of advantage for example in the case of luminaires in offices with many computer-screen work stations, since the light emitted downwardly is to a certain degree made transversely non-dazzling and thus can cause no reflections on the screens.

The luminaire illustrated in FIG. 14 of DE 44 43 916 A1 has further a concavely curved outer reflector 22 onto which there falls light emitted by the lamp 21 to the sides or upwardly. In this manner, the region surrounding the lamp 21 and the raster reflector 26 is additionally brightened, which on the one hand makes it possible to recognize in a simple manner whether the luminaire is in fact switched on or off, but on the other hand is also perceived by an observer as significantly more pleasant than the light of a pure raster luminaire, with which the entire light is emitted solely downwardly, so that the ceiling region itself appears dark.

With such lamps it is as a rule desired that the region surrounding the lamp appears with a uniformity of brightness. This problem is addressed for example also in DE 43 36 923 A1. Thus, as a rule, the outer reflector of such a luminaire has a particular curvature, exactly calculated in advance, which reflects the light emitted to the sides from the lamp in such a manner that the outer reflector appears uniformly bright. However, this mostly has the consequence that the outer reflector, due to this predetermined curvature, has a relatively great height and slight width, so that overall the luminaire is very high. If, on the contrary, the outer reflector 22 were configured to be flatter, this would have the consequence that the light density in the regions of the outer reflector 22 neighboring the lamp 22 is higher than at the edge of the reflector. With the luminaire illustrated in FIG. 14 a uniform distribution of brightness is additionally supported in that below the outer reflector 22 there is arranged a translucent (opalescent) plate 23. Overall, however, this luminaire also has a relatively great height.

It is the object of the present invention to provide a luminaire which has a significantly less height than the known luminaires and with regard to its form offers more possibilities for design variations.

The luminaire in accordance with the invention has a tube-shaped gas discharge lamp, at least one concavely curved reflector arranged, seen from the region to be illuminated, neighboring the lamp and at least one at least partially light permeable diffusor arranged, likewise seen from the region to be illuminated, +neighboring the lamp but before the reflector. The diffusor and the reflector bound next to the lamp at least one light entry surface and so run together at their ends away from the lamp that they enclose at least one light chamber. In accordance with the invention the ratio between the width of a light chamber and the height of a light entry surface is at least 4:1, whereby by the height of the light entry surface there is to be understood the spacing between the reflector and the diffusor present in this region. This measure has the consequence that the luminaire can be configured overall significantly flatter, and further the possibility arises of giving the luminaire a completely new appearance.

For the case that the greatest spacing between the reflector and diffusor is greater than the height of the light entry surface, the ratio of the width of a light chamber to the greatest spacing is preferably at least 4:1. Particularly preferably the ratio of the width of a light chamber to the height of the light entry surface, or to the greatest spacing between the reflector and the diffusor, lies between 4:1 and 5:1.

For attaining a uniform light density over the reflector cross-section there may be provided a plurality of additional means on the luminaire. Preferably for example the light entry surfaces for the light chamber or light chambers are likewise formed by means of diffusors. A further possibility consists in that the light entry surfaces are so formed that a high proportion of the light emitted from the lamp into a light chamber is deflected onto more distant regions of the reflector. For this purpose the above-mentioned diffusers, forming the light entry surfaces, may for example have different light permeabilities, or there exists the possibility to arrange optical elements—for example prism structures or the like—in the light entry surface, which deflect the light in the desired manner onto the reflector. Preferably, the surface of the deflector is likewise diffusely reflective, but it can also be so configured that the regions lying more distant from the lamp have a higher degree of reflection than the regions near to the lamp, which likewise encourages uniformity of the light density. A further measure can consist in that the diffusor arranged before the reflector also has a light permeability dependent upon the distance to the lamp.

In order to be able to employ the light emitted from the lamp downwardly for effective illumination there may be arranged below the lamp a light distributor element, for example a raster consisting of side reflectors and transverse lamellae. Other optical elements would also be conceivable, which bring about an interesting appearance of the overall luminaire, for example a partially light permeable perforated sheet or the like.

Further developments of the luminaire can consist in that the reflector arranged to the sides of the lamp is itself partially permeable. There then exist the possibility of arranging behind this partially light permeable reflector further light sources, which can be employed for the attainment of particular lighting effects. On the other hand, in this case a ceiling region lying above the luminaire can also be brightened.

If the reflector is partially light permeable, a further development can thus also consist in arranging behind the reflector a further reflector so that behind the light chambers in each case a further light chamber is formed. There then exists the possibility of providing additional light sources within these further light chambers, which for example may be controllable in their color and brightness. Here, for example, controllable light emitting diodes (LED'S) may be involved. Thereby, again, a multiplicity of different lighting effects can be attained. The formation of this additional light chamber or light chambers may be effected, however, also independently of the above-indicated size ratio for a light chamber.

Finally, for attaining a further new lighting effect it may also be provided that within the light entry surface there are arranged optical elements which bring about a color change of the light on the reflector, so that the region surrounding the lamp appears in a somewhat different color.

The luminaire in accordance with the invention can find employment in a plurality of different types of luminaire.

BRIEF DESCRIPTION OF THE DRAWINGS

Below, the invention will be described in more detail with reference to the accompanying drawings.

DETAILED DESCRIPTION OF THE PREFERRED EMBODIMENTS

Figure 1:
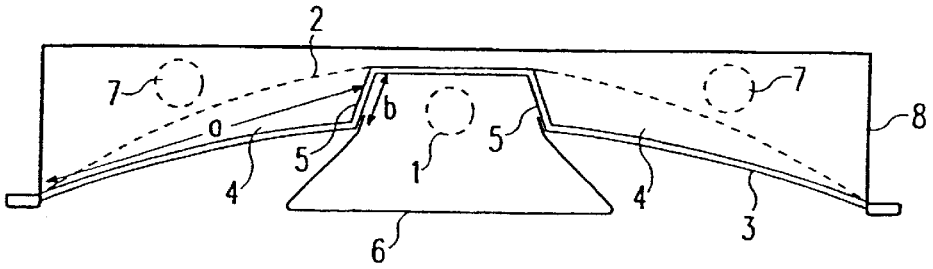
FIG. 1 is a diagrammatic cross-section view of a first exemplary embodiment of a fitted sealing luminaire in accordance with the invention.

In the case of the ceiling recessed luminaire illustrated in FIG. 1, the individual components of the luminaire are arranged within a box-shaped container 8, which upon mounting of the luminaire is sunk into the ceiling of the room to be illuminated. A rod-shaped gas discharge lamp 1 serves as light source, beneath which there is arranged a raster 6 consisting of side reflectors and transverse lamellae, via which a major part of the light given off by the lamp 1 is emitted downwardly. Thereby, the concrete shapes of the raster 6 can be so selected that the downwardly emitted light is to a certain degree free of transverse dazzling, so that the luminaire is suitable in particular for the illumination of rooms with computer-screen work stations. Alternatively to the raster 6 there can be employed also a perforated sheet, which is backed for example with foils or another optical element—for example a diffusor or a prism structure.

The rod-shaped gas discharge lamp 1 is further spanned above by a concavely curved reflector 2, the side wings of which are in substance arranged neighboring the lamp 1. Before this reflector 2, and thus likewise to the sides of the lamp 1, there is further arranged a diffusor 3 which together with the reflector encloses two light chambers 4, in that the diffusor 3 and the reflector 2 both run together at their ends away from the lamp 1. Thereby, the light entry surfaces for these light chambers 4 are bounded by the upper edge of the raster 6 and the reflector 2. Since the diffusor 3 arranged before the reflector 2 extends up to the side wall of the raster 6 it is avoided that the lamp, considered from the side, can be directly observed and thereby dazzle effects arise.

The width (a) of the light chambers 4 is, in accordance with the invention, at least four times as great as the height (b) of the light entry surfaces, that is the spacing between the upper edge of the raster 6 and the reflector 2, so that the luminaire overall can be configured very flat and optically appealing. Preferably the size ratio lies between 4:1 and 5:1.

For attaining a uniform light density over the entire width of the reflector 2 it is further provided in the case of the luminaire illustrated in FIG. 1 that the two light entry surfaces are formed by means of diffusers 5, which distribute the light thrown onto the reflector 2 more uniformly. Together with the diffusor 3 arranged before the reflector 2 it is thus brought about that the region of the luminaire surrounding the lamp 1 and the raster 6 appears uniformly bright, despite the only slight height of the luminaire. Thereby, the diffusors 5 are preferably formed together with the diffusor 3 in one piece. Further, the reflector 2 may be diffusely reflective on its inner side.

In the illustrated example the reflector 2 is further formed to be partially light permeable, whereby behind this reflector 2 two further rod-shaped lamps 7 are arranged. These are not necessary for the attainment of the desired lighting effect—effective emission of a major part of the light given off by the lamp 1 via the raster 6 downwardly, and uniform brightening of the region surrounding the lamp 1—but with their help additional and new lighting effects can be fulfilled. The two lights 7 may for example be set to a certain brightness independently of the light 1, so that by this the possibility is provided to brighten the region arranged neighboring the lamp 1 independently of the brightness of the lamp 1.

Figure 2:
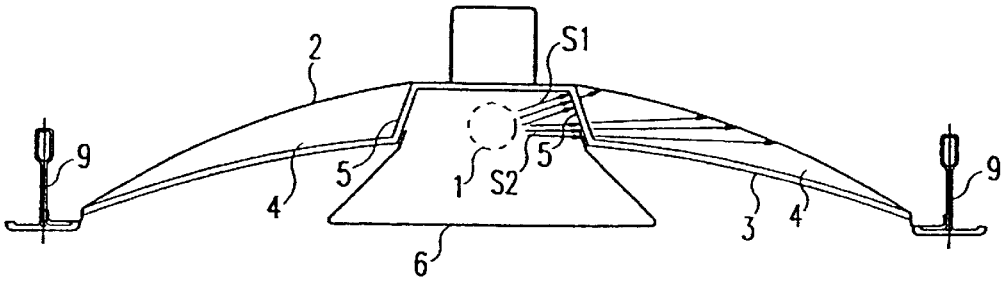
FIGS. 2 to 13 are diagrammatic cross-section views of further embodiments of the luminaire in accordance with the invention.

With the luminaire illustrated in FIG. 2 there is involved a luminaire fitting for a lighting track system. Thereby, the luminaire is hung in two rails 9 anchored to the ceiling and arranged to the sides of the luminaire. Otherwise, in its construction, this luminaire is very similar to the ceiling recessed luminaire illustrated in FIG. 1, whereby however in this example the reflector 2 is not partially light permeable. The two light entry surfaces for the light chambers 4 are again formed by means of two diffusors 5 which however have a light permeability which changes over the height of the diffusor 5. Thereby, light rays S1, which are emitted by the lamp 1 in the direction of closer region of the reflector 2, are relatively strongly weakened, whilst light rays S2 directed to regions of the reflector 2 more distant from the lamp 1 pass through the diffusor 5 more or less unweakened. As a consequence this brings about a further evening out of the light density attained on the reflector 2.

Figure 3:
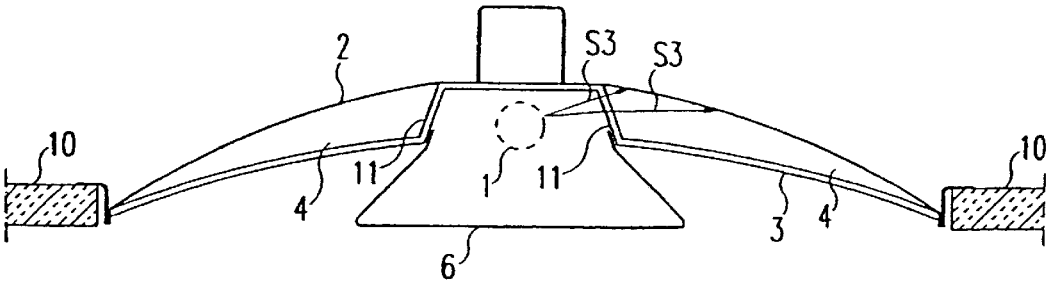

In the case of the luminaire illustrated in FIG. 3 there is involved likewise a fitting luminaire which in this case is hung in two suspended ceiling elements 10 which are arranged to the sides of the luminaire. In this case the two light entry surfaces for the light chambers 4 are formed by means of a prism structure 11 which brings about that the light beams S3 given off by the lamp 1 are, upon passage through this prism structure 11, deflected to regions of the reflector 2 lying further from the lamp 1. This measure also serves to attain a more uniform light density over the reflector cross-section.

Figure 4:
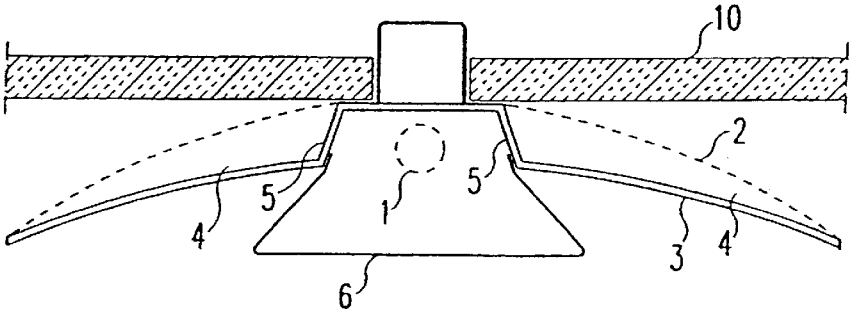

The luminaire illustrated in FIG. 4 is partially sunk in a suspended ceiling element 10, but the reflector 2, again formed to be partially light permeable, is arranged spaced from the underside of this ceiling element 10. In contrast to the exemplary embodiment illustrated in FIG. 1 now, however, there are arranged no further lights sources behind the reflector 2. The partially light permeable reflector 2 is employed in this example with a part of the light of the lamp deflected into the light chambers 4, to additionally slightly brighten the region of the ceiling element 10 lying above the lamp, which has the consequence of a further optically appealing lighting effect.

Figure 5:
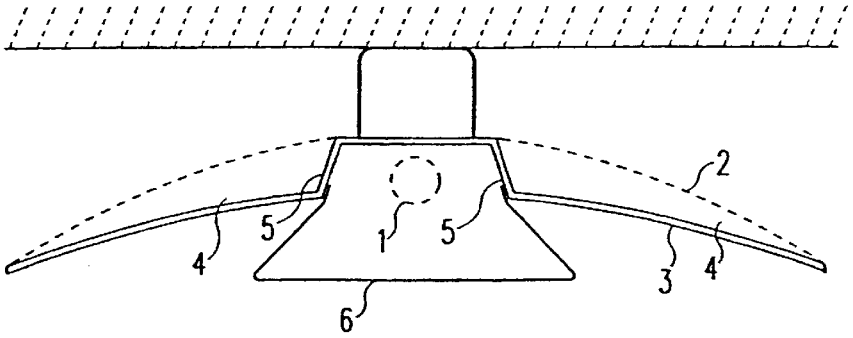
Figure 6:
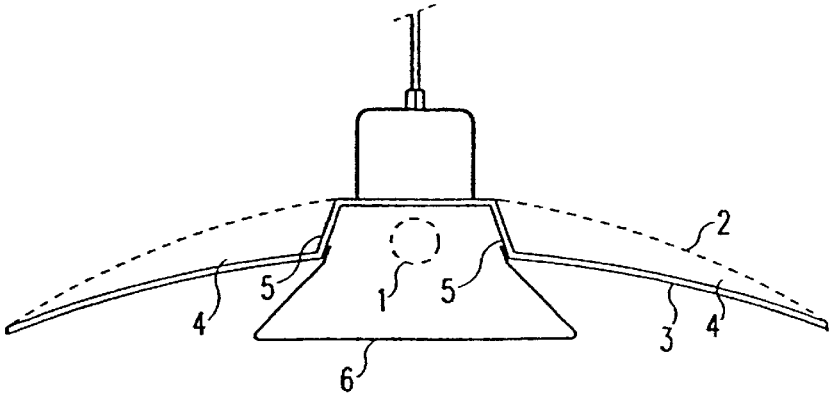

An additional brightening of the ceiling region lying above the lamp is also attained with the exemplary embodiments illustrated in FIGS. 5 and 6, which involve a ceiling surface-mounted luminaire (FIG. 5) and a hanging luminaire (FIG. 6), which correspond in their further structure to the luminaire illustrated in FIG. 4. Along with the above-explained measures for the attainment of a uniform lighting density over the reflector cross-section it may however also be provided that the reflector 2 is so formed that the regions lying further from the lamp 1 have a higher reflective capacity than the regions lying nearer to the lamp 1. A further measure could moreover consist in that the regions of the diffusor 3 lying further from the lamp 1 have a higher light permeability than regions lying near to the lamp 1.

Figure 7:
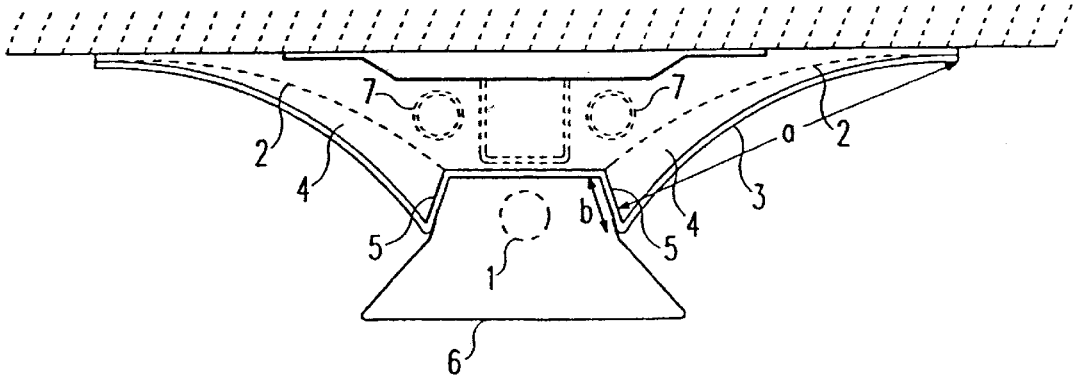

The luminaire illustrated in FIG. 7 is likewise configured, as a ceiling surface-mounted luminaire, but has however a different reflector form. In contrast to the previous embodiment the reflector 2 is no longer formed in one piece but consists of two concavely curved side wings extending laterally towards the ceiling. The ratio in accordance with the invention between the width (a) of the light chambers 4 and the height (b) of the light entry surfaces is also fulfilled here.

The two side wings of the diffusor 3 arranged before the reflector 2 also extend to the ceiling so that seen overall a continuous transition from the luminaire to the ceiling is attained. Here also there are formed between the upper edge of the raster reflector 6, arranged below the lamp 1, and the reflector 2 light entry surfaces for the light chambers 4, which in turn are formed by means of two diffusors 5. As in the first exemplary embodiment, the reflector 2 is again formed to be partially light permeable and for the attainment of further lighting effects there are arranged above this reflector 2 two further lamps 7.

Figure 8:
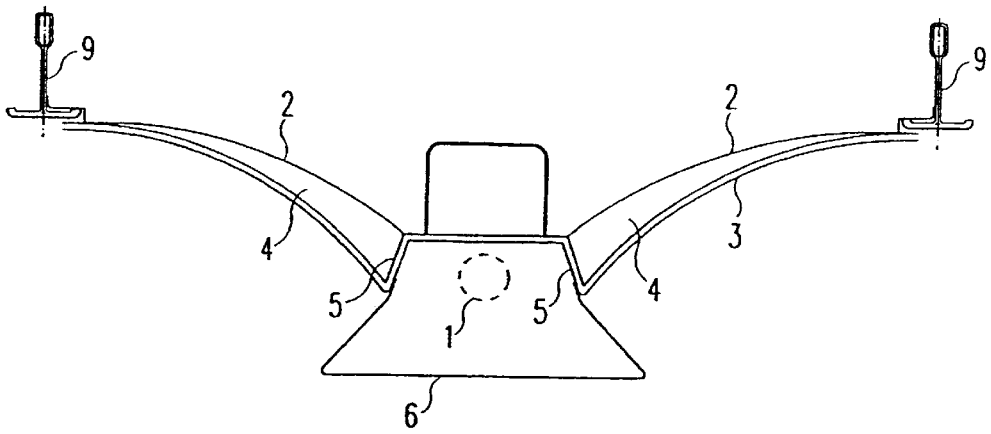
Figure 9:
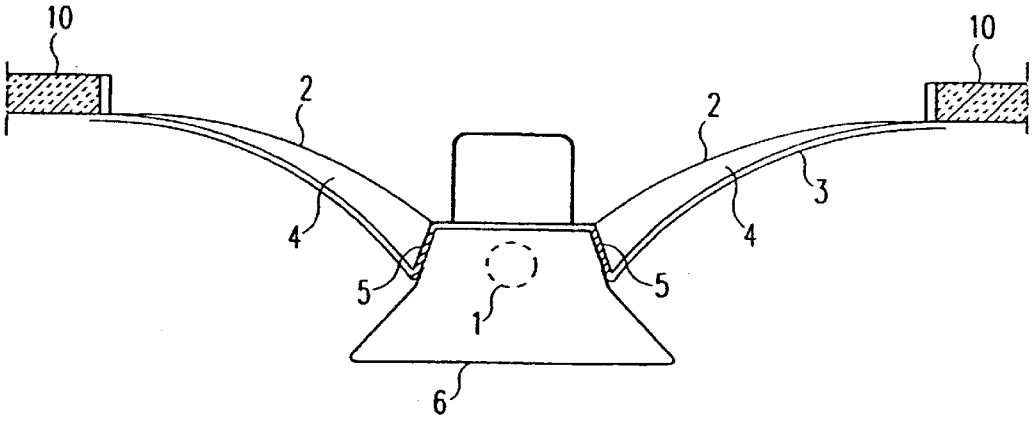

In FIGS. 8 and 9, the luminaire illustrated in FIG. 7 is again configured as a fitting luminaire for a lighting track system or for a suspended ceiling system. With the example illustrated in FIG. 9, the two diffusors 5 are however additionally provided with color filters, so that the light deflected into the light chambers 4 has a different color composition than the light emitted downwardly via the raster reflector 6. This has the consequence that the region surrounding the lamp 1 appears in a somewhat different color, so that through the choice of a suitable color filter certain moods can be attained. For example a very pleasant atmosphere can be provided in that the light deflected onto the reflector 2 is given a somewhat warmer color tone with the aid of a, for example, slightly yellow or orange colored color filter. In contrast thereto, more blue light is perceived as rather cold, which would suggested itself for example in warmer regions. Since, however, the light emitted downwardly via the raster 6 is not altered in its color composition or in its intensity, there is made possible as before an effective illumination of the region lying below the luminaire.

Figure 10:
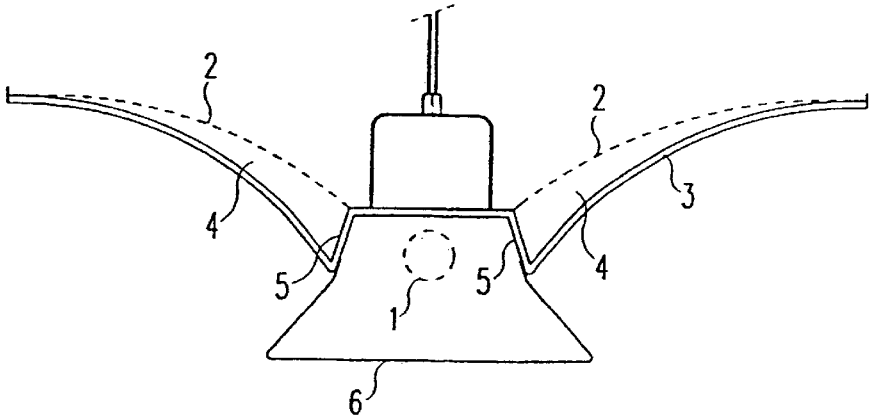

FIG. 10 shows a further exemplary embodiment in which the previously illustrated luminaire having the laterally upwardly extending side wings is provided as a hanging or suspended luminaire, whereby again the reflector 2 is formed to be partially light permeable, to attain a-brightening of the ceiling region.

In the case of the luminaire illustrated in FIG. 11 there is involved again a ceiling recessed luminaire, the reflector 2 of which now however has such a form that the greatest spacing (c) between the reflector 2 and the diffusor 3 is greater than the height (b) of the light entry surfaces. In this case preferably not only the ratio between the width (a) of the light chambers 4 to the height (b) of the light entry surfaces, but also the ratio of the width (a) of the light chambers 4 to the greatest spacing (c), is at least 4:1, so that a flat structural form is ensured. Again, the size ratio lies preferably between 4:1 and 5:1.

Figure 11:
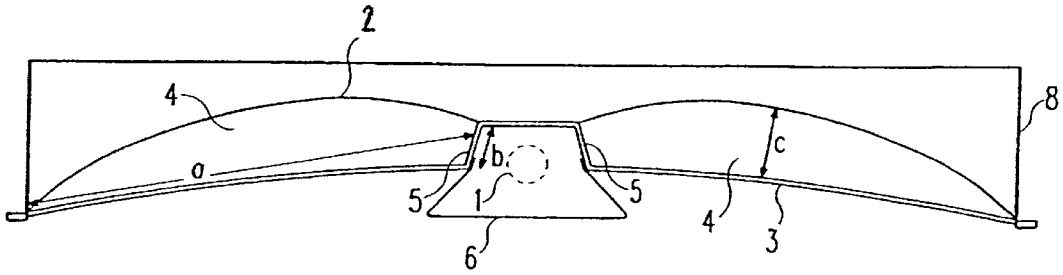
Figure 12:
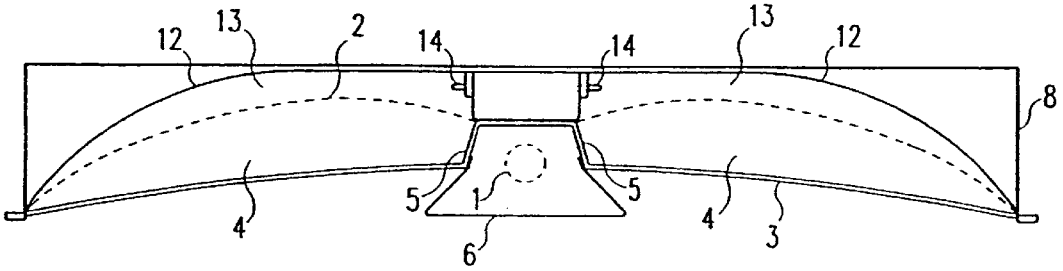
Figure 13:
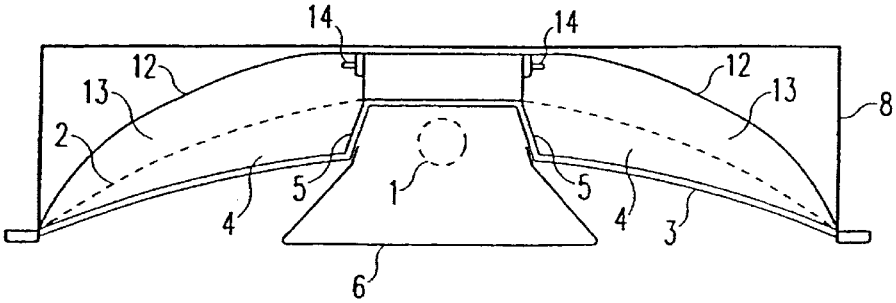
Figure 14:
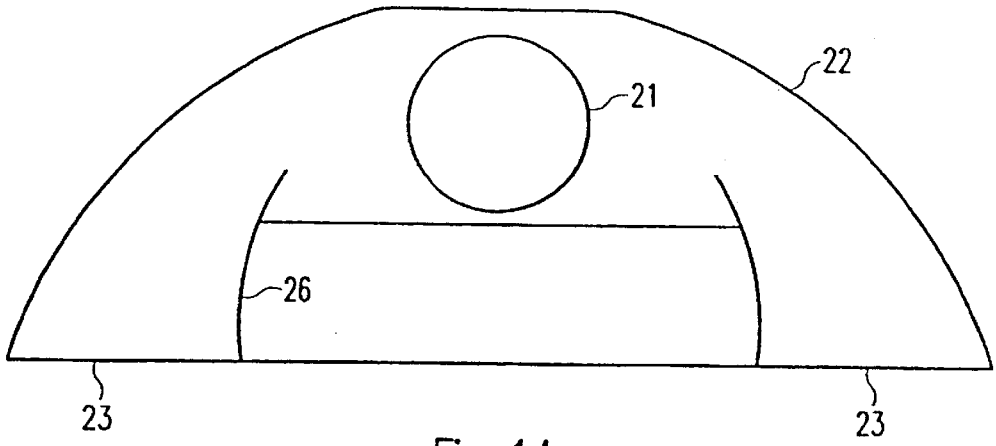
FIG. 14 is a diagrammatic cross-section view of luminaire known from the state of the art.

FIGS. 12 and 13 finally show a further development of the luminaire in accordance with the invention, which offers itself in particular in the case of ceiling recessed luminaires, whereby the form of the luminaire illustrated in FIG. 12 corresponds to the luminaire form of FIG. 11 and the form of the luminaire in FIG. 13 corresponds to the luminaire form of FIGS. 1 to 6. The development consists in that behind the reflector 2, configured to be partially light permeable, there is arranged a further concave reflector 12 which together with the reflector 2 forms two further light chambers 13, which are each arranged behind the original light chambers 4. In these additional light chambers 13 there are arranged further light sources, here in the form of printed circuit boards with a plurality of LED's 14 arranged in a row. These LED's 14 may be controllable with regard to their color and brightness, whereby a multiplicity of different light effects can be attained. Of course, also other controllable light sources may be put to use. Further, the formation of the further light chambers 13 can be effected by means of the additional reflector 12 also in the case of other luminaire types and luminaire forms.

The luminaire in accordance with the invention can thus be configured in multiplicity of different appearances; for example as recessed luminaire, surface-mounted luminaire, and suspended luminaire, but also as a standard lamp. Within the scope of these configurations the above-described various reflectors, diffusors, lamp arrangements, or lighting means arrangements, color filters, rasters, perforated sheets, and prism structures can be combined as desired. Since the height of the light chambers 4 is very small, there further exists the possibility of providing luminaires which are overall very flat and optically appealing and to give them new forms with an appealing design. By means of the further proposed measures there can be attained, however, despite the very flat constructional form, that a substantially uniform light density is attained over the entire width of the reflector 2, so that also very appealing lighting effects can be attained.

What is claimed is:

1. A luminaire comprising:

a tube-shaped gas discharge lamp;

at least one concavely curved reflector arranged neighboring said lamp, as seen from a region to be illuminated by said lamp; and at least one partially light permeable diffusor also arranged neighboring said lamp and positioned in front of said reflector, as seen from said region to be illuminated by said lamp;

wherein said diffusor and said reflector are spaced apart from each other in a region next to said lamp and run together at their ends away from said lamp, to define at least one light chamber having a light entry surface which is next to said lamp and which has a height, and said light chamber having a width which extends from said light entry surface to said ends, and the ratio of said width to said height being a ratio of at least 4:1.

2. A luminaire according to claim 1, wherein said diffusor and said reflector have a spacing which is greater than said height, and wherein the ratio of said width to said spacing being at least 4:1.

3. A luminaire according to claim 1, wherein said ratio of said width to said height is between 4:1 and 5:1.

4. A luminaire according to claim 2, wherein said ratio of said width to said spacing is between 4:1 and 5:1.

5. A luminaire according to claim 1, further including additional means to attain uniform light density over the reflector cross-section.

6. A luminaire according to claim 5, wherein said at least one light entry surface is formed by a diffusor.

7. A luminaire according to claim 5, wherein said at least one light entry surface is formed by an optical element which is so configured that a higher proportion of light from said lamp falling into said light chamber is defected top more distantly lying regions of said reflector.

8. A luminaire according to claim 5, wherein regions of said diffusor which lie more distantly from said lamp have a greater light permeability than regions lying nearer to said lamp.

9. A luminaire according to claim 5, wherein regions of said reflector which lie more distantly from the lamp have a higher reflectivity than regions of said reflector lying nearer to said lamp.

10. A luminaire according to claim 5, wherein regions of said reflector lying more distantly from the lamp have a higher reflectivity than regions of said reflector lying nearer to said lamp.

11. A luminaire according to claim 1, wherein a light distributor element is arranged in front of said lamp as seen from a region to be illuminated by said lamp.

12. A luminaire according to claim 10, wherein said light distributor element is a raster which has side reflectors and transverse lamellae.

13. A luminaire according to claim 10, and further including a partially light permeable perforated sheet arranged below said lamp as seen from a region to be illuminated by said lamp.

14. A luminaire according to claim 1, wherein said reflector is partially light permeable.

15. A luminaire according to claim 13, and further including at least one further lamp arranged behind said partially permeable reflector as seen from a region to be illuminated by said lamp.

16. A luminaire according to claim 13, and further including a further concavely curved reflector arranged behind said partially light permeable reflector as seen from a region to be illuminated by said lamp and which forms, together with said partially light permeable reflector, at least one further light chamber arranged behind said light chamber; and a further light source arranged in said further light chamber.

17. A luminaire according to claim 15, wherein said further light source comprises a plurality of light emitting diodes.

18. A luminaire according to claim 16, wherein said light emitting diodes are controllable with regard to their brightness and color.

19. A luminaire according to claim 1, wherein said at least one light entry surface contains a color filter.

20. A luminaire comprising:

a tube-shaped gas discharge lamp;

at least one concavely curved reflector arranged neighboring said lamp, as seen from a region to be illuminated by said lamp; and at least one partially light permeable diffusor also arranged neighboring said lamp but in front of said reflector, as viewed from said region to be illuminated by said lamp, wherein said diffusor and said reflector bounding, next to said lamp, are spaced apart from each other and run together at their ends away from said lamp, to define at least one light chamber having a light entry surface which is next to said lamp, and which has height, and said light chamber having a width which extends from said light entry surface to said ends, said reflector being partially light permeable;

a further concavely curved reflector arranged behind said reflector, as viewed from said region to be illuminated by said lamp, said reflector and said further reflector forming therebetween at least one further light chamber behind said light chamber; and a further light source arranged in said further light chamber.

* * * * *